US008770229B2

(12) United States Patent
Gopalan et al.

(10) Patent No.: US 8,770,229 B2
(45) Date of Patent: Jul. 8, 2014

(54) FLUID STREAM POWERED PULSE GENERATING FLUIDIC OSCILLATOR

(75) Inventors: Shridhar Gopalan, Westminster, MD (US); Kerrie Allen, Laurel, MD (US); Gregory Russell, Catonsville, MD (US); Jerry Thurber, Woodbine, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 276 days.

(21) Appl. No.: 13/107,848

(22) Filed: May 13, 2011

(65) Prior Publication Data

US 2012/0055560 A1 Mar. 8, 2012

Related U.S. Application Data

(60) Provisional application No. 61/334,266, filed on May 13, 2010.

(51) Int. Cl.
*F15C 1/08* (2006.01)
*B05B 1/08* (2006.01)

(52) U.S. Cl.
USPC ..... 137/841; 137/840; 239/589.1

(58) Field of Classification Search
USPC ..... 137/803, 834–840, 841; 239/589, 239/589.1, 548, 568
See application file for complete search history.

(56) References Cited

U.S. PATENT DOCUMENTS 3,496,956 A * 2/1970 Taplin et al. ..... 137/832
3,586,024 A * 6/1971 Tuzson et al. ..... 137/826
6,767,331 B2 * 7/2004 Stouffer et al. ..... 601/150

* cited by examiner

*Primary Examiner* — Craig Schneider
*Assistant Examiner* — Michael R Reid
(74) *Attorney, Agent, or Firm* — J.A. McKinney & Assoc., LLC

(57) ABSTRACT

A fluidic device which produces fluid pulses having a selected pulse repetition frequency, pulse duration, pulse peak pressure and pulse peak flow rate includes first, second and third fluid flow controlling channels or lumens which converge in a junction, defining a "Y" configuration having a base leg and right and left diverging arms. The first leg portion has a fluid input and terminates downstream at the Y junction of the base and the two diverging arms. The first leg has converging walls which reduce the cross sectional area of the flow to thereby increase the fluid velocity to make a fluid jet. The second or right leg, begins at the Y junction and terminates distally in an enclosed, fluid-tight container having a selected blind volume. The third, or left leg, begins at the Y junction and terminates distally in a fluid outlet passage having a selected cross-sectional area.

14 Claims, 4 Drawing Sheets

Another example at 2 1pm. with a scaled down version of the device shown in Figs 1 and 2:

Flow = 21pm (air), input pressure = 1.5psi, frequency = 8Hz, peak amplitude ~ 14 cm of water. Note 1 psi = 70cm of water.

FLUID STREAM POWERED PULSE GENERATING FLUIDIC OSCILLATOR

BACKGROUND OF THE INVENTION

This application claims the benefit of U.S. Provisional Application No. 61/334,266, filed 13 May 2010, and entitled "Fluid Stream Powered Pulse Generating Fluidic Oscillator", The disclosure of which is hereby incorporated herein by reference.

FIELD OF THE INVENTION

The present invention relates to methods and apparatus for generating pressurized pulses of gas or liquid, and more particularly to a fluidic circuit responsive to an inlet fluid flow to produce a pulsed outlet fluid stream. Still more particularly, the invention is directed to a fluidic oscillator in which fluid flow pulses of selected pulse repetition frequency, pulse duration, peak pulse pressure and/or pulse peak flow rate are produced.

DISCUSSION OF THE PRIOR ART

As is well known, pneumatic pumps and electric pumps can be operated and controlled to generate periodic pulses of pressurized fluids such as liquids or gases. Such systems typically utilize control circuits which periodically energize the pumps or which control switching valves to generate a desired sequence of pressurized pulses, but often require robust switching systems utilizing high-maintenance mechanical valving arrangements. Other systems may utilize "check valves" which interrupt fluid flow to produce pressure pulses without the need for external control circuits, typically by the use of moving valve components in the flow path, but these have the disadvantage of requiring high input pressures and have frequencies that are difficult to control. The complicated systems of the prior art are expensive to make and maintain, and utilize moving parts that often require continuous maintenance.

An improvement over such prior mechanical switching systems is found in the use of so-called fluidic switching systems such as that exemplified by the fluidic pulse generator described in commonly owned U.S. Pat. No. 6,767,331 to Stouffer, et al, which discloses a backload-responsive fluidic switch. This patent illustrates a structure for generating a time-varying flow of fluid, wherein a flexible bladder is connected to a power nozzle in a fluid flow passage in a fluidic circuit to receive the input fluid flow to increase pressure in the bladder. At a set pressure in the bladder, the input fluid flow is switched to a different fluid flow passage that includes a vent that is open to the atmosphere, and pressure is "recovered" from the flexible bladder. The purpose of the '331 patent is to drive the inflatable bladder, causing it to expand and contract as a massaging apparatus. Thus, in the device of the '331 patent, an output port is open to the atmosphere as well as to a vent, but no supply of fluid is provided, and an inflatable bladder is connected to the right leg, which expands and contracts as a massaging apparatus. The '331 patent does not, however, describe a way of delivering a continuously pulsed supply of a fluid to an output, and thus does not solve the problems of earlier mechanical pulsed systems, but, nevertheless, is incorporated herein in it's entirely, to supplement the background of this disclosure.

Another commonly owned prior art fluidic oscillator is described in U.S. Pat. No. 6,805,164 to Stouffer, which discloses a structure for generating a time-varying flow of liquid only, but applicants have discovered that the '164 structure is not useful for generating pulses solely with air or another gas and is also not effective for use in liquid/gas micro-irrigation applications. The '164 structure consists of a switching chamber 10 having an inlet port 12 and two outlet ports, an exhaust port 14 and a container port 16. To the container port 16 is connected a container passage 18 which connects at its distal end to an integral container 20 having a fixed or defined volume. This integral container and its contents work together to provide this distal end with specified compliance or expansion capabilities. To the exhaust port 14 is connected an exhaust passage 22 which contains at its distal end an opening 24 that connects to an exhaust port expansion chamber 26 having a specified width, W, length, L and an orifice 28 of a specified dimension, D. To the inlet port 12 is connected a source of pressurized fluid 30 via an inlet passage 32.

In the method and structure of U.S. Pat. No. 6,805,164, water or other liquid from a source flows through the inlet port 12 and because it is at sufficient pressure, enters the switching chamber 10 as a jet. Because air can be entrained through the expansion chamber's orifice 28 to satisfy the jet's entrainment requirement on its left side, the jet initially tries to attach to the chamber's right wall where a Coanda bubble forms, thereby producing a lower pressure area on the jet's right side. See '164 patent's FIG. 15(*a*) where water is entering the fluidic 1 and the integral container 20 contains air. The pressurization of the container continues until, in FIG. 15(*b*) the flow stops in the right leg and the right-hand Coanda bubble is increased in pressure. Then, when the pressure differential across the jet is reversed, so that the left side pressure is lower than the right, the jet switches to the left side of the chamber, see FIG. 15(*c*), with such a speed and intensity as to create a pressure wave in the fluidic's exhaust passage and expansion chamber. This pressure wave causes the output water flow to issue a rapid, top-hat profiled jet, see FIG. 15(*d*), that subsequently expands into various liquid spray shapes depending on the values of the geometric variables of L and D of the fluidic's expansion chamber. The '164 patent does not, however, describe a way of delivering a continuously pulsed supply of a gas to an output, does not provide a way of altering the frequency of the liquid jets and does not provide an adjustable structure and method for use in therapeutic applications such as micro-irrigation, but, nevertheless, is incorporated herein in it's entirely, to supplement the technical background of this disclosure.

There is a need, therefore, for an inexpensive and reliable system and method for generating periodic pulses of pressurized liquid or gas at selectable pulse repetition frequencies which overcomes the problems of the prior art.

SUMMARY OF THE INVENTION

It is, therefore, an object of the present invention to overcome the above mentioned difficulties by providing an inexpensive, adjustable and reliable source of pulsed pressure liquid or gas.

It is also an object of the invention to provide a pulsed fluid device with no moving parts and no fluid venting to the ambient.

It is a still further object of the invention to provide an adjustable modulated pulse fluid flow device having no moving parts, wherein pulse repetition frequency, pulse duration, pulse peak pressure and pulse peak flow rate are selectably controllable for both gas and liquid fluids.

Briefly, in accordance with the present invention, a fluidic oscillator, which may also be referred to as a fluidic pulser or pulsator device, is provided which operates with no moving parts and achieves a pulsating pressure effect due solely to fluid interaction effects caused by its fluidic circuit geometry. The device works with liquids or gases, and more particularly with either water or air. The fluidic pulser of the present invention is powered, in the illustrative embodiment, solely from the energy of an inlet fluid stream, where the fluid to be delivered to an outlet in modulated pulses comes from a pressurized fluid source, and requires no external power supply. Fluid pressures at the inlet can vary from 1 to 60 pounds per square inch (psi), while the delivered flow rates can range from 0.25 to 100 liter per minute (lpm), with an output pulsation frequency that can be varied from 1 to 100 pulses per second (Hz).

In an illustrative example of the present invention, a fluidic device, or circuit, which is configured to produce pulses of fluid flow having a selected pulse repetition frequency, pulse duration, pulse peak pressure and pulse peak flow rate includes first, second and third fluid flow controlling channels which converge in a junction, defining a "Y" configuration having a base leg and right and left diverging arms. The first fluid controlling channel, or leg portion, has a proximal fluid input or inlet at a first end and terminates downstream or distally at the Y junction of the base and the two diverging arms. This first fluid controlling channel has gradually converging walls which are configured to reduce the cross sectional area of the flow from the fluid input and to thereby increase the fluid velocity to make a fluid jet. The second fluid controlling channel, or right leg, begins at the Y junction, broadens or diverges gradually and terminates distally in an enclosed, fluid-tight container having a selected blind volume. The third fluid controlling channel, or left leg, begins at the Y junction, broadens or diverges gradually and terminates distally in a fluid outlet passage having a selected cross-sectional area.

A selected fluid (e.g., air or another gas, or a liquid) is supplied under pressure to the fluidic device at the fluid input or inlet to the first leg and passes inwardly, distally or downstream toward the Y junction. The convergence of the inlet or first channel's walls produces a fluid jet, and because the second channel and third channel do not diverge at the same angle from the junction (the left leg is at a slightly greater angle with respect to the inlet flow through the inlet or base leg), the inlet fluid flow attaches initially to the channel wall leading into the right leg. The flow is thereby biased towards the right leg at the Y junction, and at the start of operation, tends to flow in that direction. The distal end of the right leg is in fluid communication with a fluid-tight container such as a closed empty bag or box defining a selected blind volume. Due to the bias of the flow to the right leg of the fluidic circuit, the inlet fluid enters and pressurizes the blind volume, increasing the pressure within the blind volume as fluid continues to flow into the right leg or channel. At the same time, there is little or no flow to the left leg at the Y junction and there is little or no output flow through this leg.

The pressure inside the blind volume increases with incoming fluid flow until a critical pressure is reached. Once the critical pressure in the blind volume has been achieved, the fluid flow at the Y junction is affected because the wall attachment of the incoming fluid jet cannot sustain the jet's flow into the right leg anymore, and the jet is thereby forced away from the right leg and incoming flow switches to the left or output leg of the circuit and to the output at the distal end of the left leg.

When the pulse generator of the present invention is to be used with a fluid that is solely a gas, an optional vent tube, duct or lumen can be connected to define a vent channel from the right leg channel, with the vent leading through a narrow interconnect channel to the output or distal outlet end of the left channel or leg. In those applications using gas, while the inlet fluid jet has switched to the left, or output leg, the gas accumulated in the selectable blind volume starts bleeding out through the output vent hole and vent channel. Since the interconnect channel connects the output vent hole to the output leg, no gas (e.g., air) is vented to the atmosphere, but is directed to the pulse generating circuit's outlet. As the air in the blind volume bleeds away, the pressure in the blind volume (and hence the right leg) drops below the lower critical pressure and the incoming flow of the fluid jet then switches back to the right (or biased) leg, and the cycle of switching between biased flow into the right leg and the upper critical pressure-directed flow to the left (or outlet) leg repeats, producing at the output a series of fluid pulses having a pulse period that is controlled by the flow rate of the inlet fluid and the selected or adjustable volume for the blind volume container, which are preferably selected in advance for a given application with a selected fluid.

If air is the fluid, the result is a pulsating outlet air stream at a frequency determined by, among other things, the selected or adjusted size of the blind volume. Larger volumes result in a lower pulse frequency, and at a given inlet flow rate, smaller volumes result in a higher pulse frequency. Therefore, an optional variable or adjustable volume container may be included with the fluid pulse generator of the present invention to permit user-adjustable control of the output pulse frequency. For devices configured with the optional vent channel, the fluid flow does not shut-off completely between pulses, meaning there is a base (steady-state or DC-like) flow. Further, for those applications where the fluid is a liquid, the device can operate with the vent channel blocked or removed (and with the vent hole blocked), and without the vent hole, for liquids, there is full shutoff (or instantaneous moments of zero flow) between pulses.

The amplitude of the pressure pulses can be controlled by the angle between the two legs of the Y and by the "inter-leg" angle between the outlet leg and the blind volume's leg, from the Y junction. The outlet end of the Y base, or inlet channel, terminates in a power nozzle lumen area at the distal or downstream terminus of the inlet leg, and this area and the lumen area of the output aperture or hole at the distal end of the right-hand, or outlet leg, are selected together to enhance the stability of the oscillations.

In an implementation of the pulse generator of the present invention, it was found that the pulser works best for air when the first, second and third channels have aspect ratios (AR) (depth/width) of 0.3-0.9, the vent hole lumen area is larger than the power nozzle area, and the output hole is considerably larger than the power nozzle area.

BRIEF DESCRIPTION OF THE DRAWINGS

The above, and still further objects, features and advantages of the present invention will become apparent upon consideration of the following detailed description of a specific embodiment thereof, particularly when taken in conjunction with the accompanying drawings, wherein like reference numerals in the various figures are utilized to designate like components, in which.

DESCRIPTION OF PREFERRED EMBODIMENTS

Figure 1:
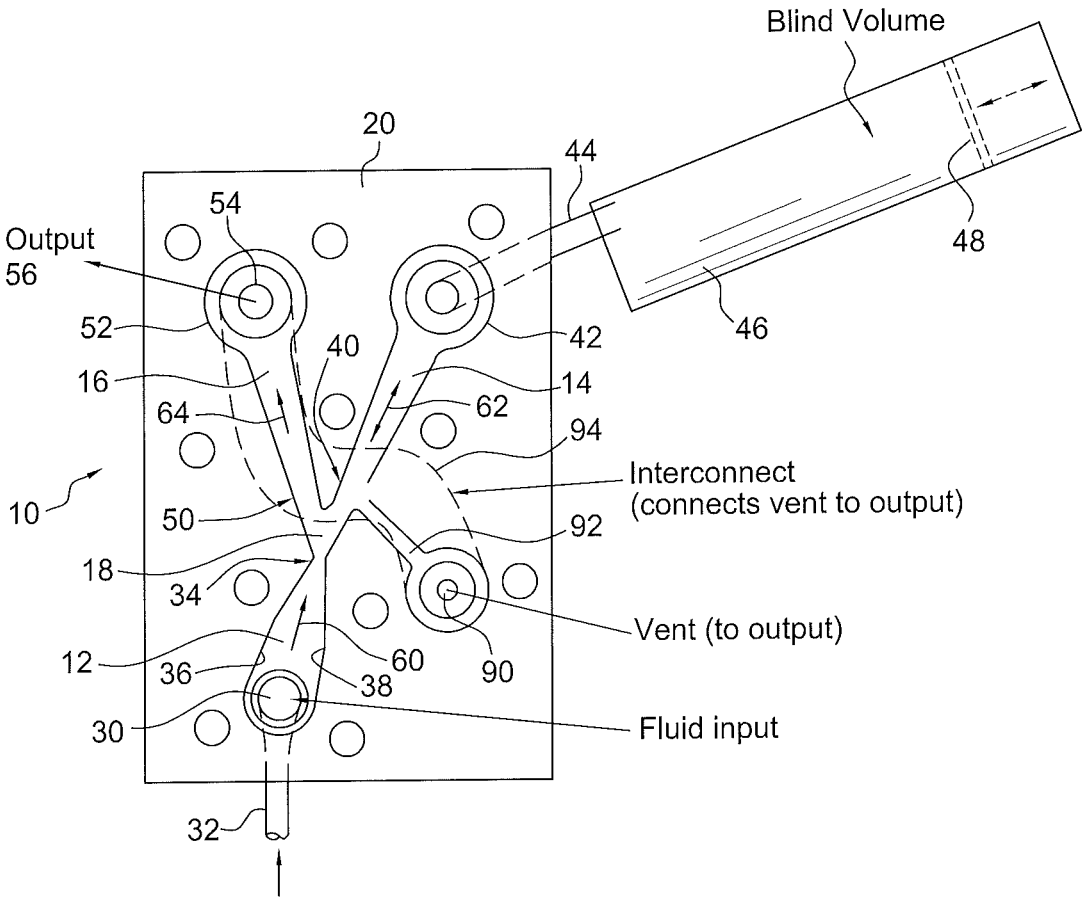
FIG. 1 is a top plan diagrammatic view of a fluidic oscillator pulse generating circuit in accordance with the present invention.

Referring now to FIGS. 1-6, wherein similar components are similarly numbered, a gas or liquid adjustable fluidic circuit oscillator or pulsator device 10 is selectively configurable to produce pulses of gas or liquid fluid flow having a selected pulse repetition frequency, pulse duration, pulse peak pressure and pulse peak flow rate. The fluidic device 10 includes first, second and third fluid flow controlling channels 12, 14 and 16, respectively, which converge in a junction 18 to defining a "Y" configuration in which the first fluid flow channel 12 forms the base leg of the Y, the second fluid flow channel 14 forms the right-hand arm of the Y, and the third fluid flow channel 16 forms the left-hand arm of the Y. As illustrated more clearly in FIG. 2, the channels may be formed in a block 20 of a suitable material such as plastic, in known manner, and covered to provide enclosed first, second and third flow channels in fluid communication with one another and with a configurable vent channel 92, for use with gasses (as described in greater detail, below).

The first fluid flow controlling channel 12 has a fluid input or inlet 30 at a first or proximal end, which is connectable to a fluid supply conduit 32 and which terminates downstream at its terminal end in an outlet power nozzle 34 at the Y junction 18. First fluid flow controlling channel 12 has gradually converging side walls 36 and 38 which are configured to gradually reduce the cross sectional area of first flow channel 12 from its fluid inlet 30 to its outlet end 34, to increase the velocity of fluid flowing in the channel 12 and to thereby produce a fluid jet at its outlet end, flowing into the junction which defines a fluid interaction or switching region 18.

Figure 2:
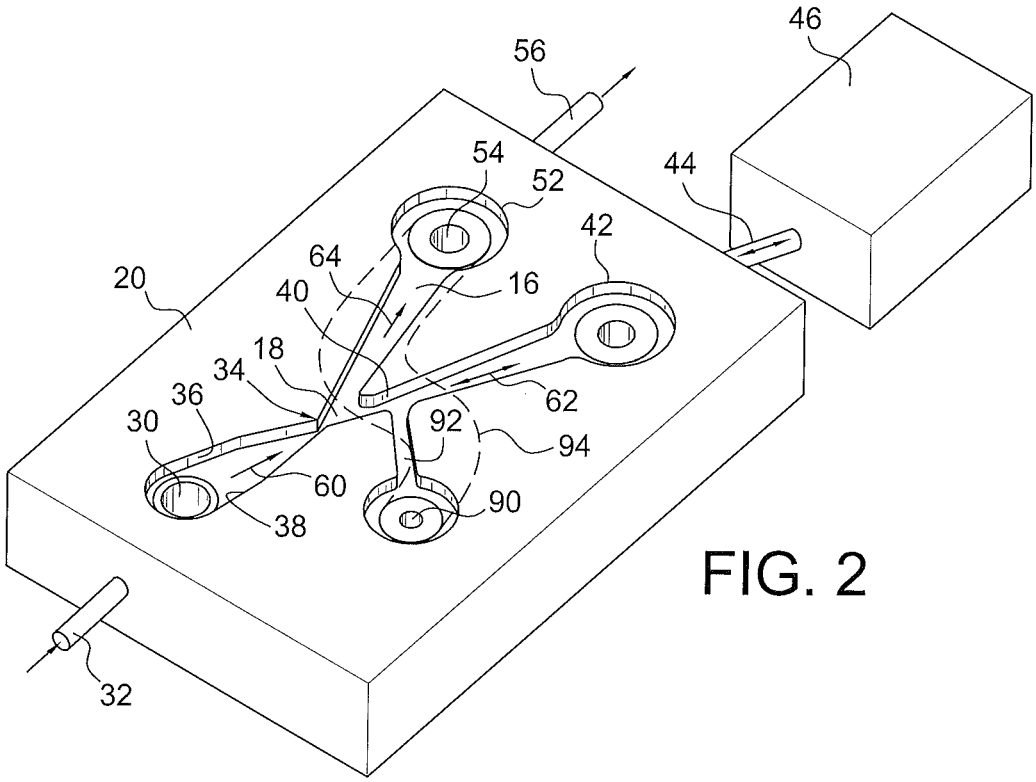
FIG. 2 is a perspective view of the device of FIG. 1.

The second fluid controlling channel, or right leg 14 of the Y configuration, begins at an inlet end 40 at the Y junction 18 and terminates at a distal end 42 which is connected via a conduit 44 to the interior of an enclosed, fluid-tight container 46 having a selected blind volume. Optionally, the container may have an adjustable blind volume, as illustrated by a movable, or adjustable, partition 48. As best seen in FIGS. 1 and 2, second fluid flow controlling channel 14 has gradually diverging side walls which are configured to gradually increase the cross sectional area of second flow channel 14 from its junction/interaction region inlet to its outlet 42 which is connected via a tube or conduit to blind volume 46. Second flow channel 14 controls fluid flow in both directions, when in use, and when fluid flows from the blind volume 46 toward junction/interaction region 18 via second channel 14, the sidewalls of second flow channel 14 can be seen to converge, thereby effectively increasing the velocity of fluid flowing from the blind volume via channel 14 and flowing into the junction/fluid interaction region 18. Thus, the second channel (or container passage) 14 and third channel (or exhaust passage) 16 have tapered sidewalls which converge toward the switching junction region 18. In addition, second channel 14 also includes a narrow, elongated lumen terminating in a gas vent hole 90 for use with a configurable vent channel 92 (as described in greater detail, below).

The third fluid controlling channel, or left leg 16 of the Y configuration, begins at an inlet end 50 at the Y junction 18, and terminates at a distal end 52 which includes a fluid outlet passage 54 leading to an outlet conduit 56, and having a selected cross-sectional area. As best seen in FIGS. 1 and 2, third fluid flow controlling channel 16 has gradually diverging side walls which are configured to gradually increase the cross sectional area of third flow channel 16 from its junction/interaction region inlet to its outlet 54 which is connected via a tube or conduit to a pulsed fluid output 56. As illustrated, the second and third fluid flow channels are tapered slightly outwardly from their inlet to their outlet ends.

Figure 3:
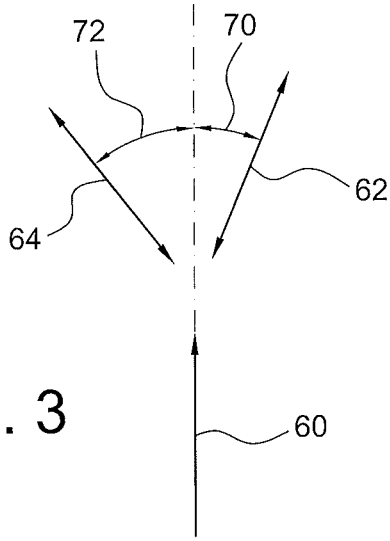
FIG. 3 illustrates flow angles in the device of FIG. 1.

The fluid flow axes of the three channels, legs or lumens 12, 14 and 16, as illustrated by arrows 60, 62 and 64, respectively, meet at the junction 18, so that inlet fluid under pressure supplied via the inlet 30 flows inwardly along channel 12 to downstream power nozzle outlet 34 in the direction of arrow 60, producing a fluid jet into the junction 18. The fluid then flows outwardly through one or the other of the fluid flow channels 14 and 16, as indicated by arrows 62 and 64. The relative directions of the legs of the fluidic circuit determines the initial direction of flow, and in accordance with the invention, this initial direction is biased toward fluid flow channel 14. This is accomplished by configuring the circuit 10 so that the axes 62 and 64 of legs 14 and 16 diverge from the axis 60 of leg 12, as illustrated in FIG. 3. As there illustrated, axis 62 diverges to the right of axis 60 (extended) by an angle 70, while axis 64 diverges to the left of axis 60 (extended) by an angle 72. In accordance with the invention, blind-volume or second channel angle 70 is smaller than outlet or third angle 72, so fluid flow along inlet channel axis 60 is biased toward the blind volume channel flow path indicated by axis 62.

In operation, the convergence of the inlet channel walls 36 and 38 produces a fluid jet which, because of the angles described above, is biased towards the right leg or second channel 14 at the Y junction 18. When a selected fluid, such as a liquid or a gas, enters the device at the fluid input or inlet 30 under pressure, it passes inwardly toward the Y junction, as described above. The right leg fluid channel 14 is in fluid communication with the fluid-tight container 46 defining the blind volume, and due to the fluid jet's bias and due to fluid flow wall attachment, the incoming fluid jet is diverted into fluid flow channel 14 and starts filling up the blind volume 46, increasing the fluid pressure within the blind volume. At this instant, there is little or no output flow through the left leg or outlet channel 16.

The pressure within blind volume 46 increases with incoming fluid flow until a first critical pressure is reached. Once the first critical pressure in the blind volume has been achieved, the fluid jet at the Y junction 18 is affected because the flow bias and the jet's wall attachment cannot sustain the jet's flow into the right leg fluid channel any more, and the jet is thereby forced away and switches to the left or output flow channel leg 16 of the fluidic circuit 10 and flows to the left leg output 54 and out of the device 10, as a pulsed fluid stream. Once this pulsed fluid flow is initiated, pressurization of the blind volume stops, and the accumulated fluid pressure in the blind volume 46 forces fluid back through second channel 14, and the pressure in the right leg fluid channel 14, begins to drop. During the time fluid flows from junction 18 to outlet 54, the blind volume pressure continues to drop until the pressure in blind volume 46 and second channel 14 drops below a second critical pressure (which will be appreciated as necessarily lower than the first critical pressure). At this point, the bias of the circuit toward fluid flow leg 14 is reestablished and the fluid flow jet switches back to the second, right, or biased, leg 14 and into the blind volume 46. This flow continues until the first critical pressure builds up to switch the jet flow once again.

Figure 4:
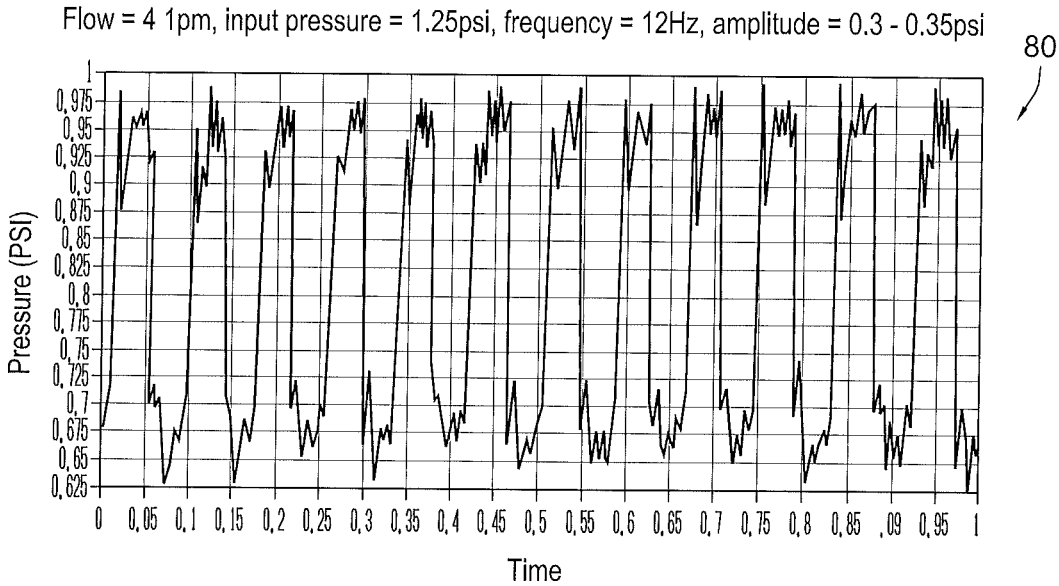
FIG. 4 is a plotted trace of the output pulses from a typical pulsed fluid output from the system of FIG. 3.

The foregoing cycle of switching between biased flow into the right or second leg and the critical pressure directed flow into the left (or outlet) leg repeats at a frequency, or period, that is established and controlled by the inlet flow rate and the selected volume for the blind volume container 46, which values are selected for a given fluid to produce a desired switching frequency. The result of the switching of the fluid jet between channels 14 and 16 results in a series of fluid output bursts, or fluid pulses, at the outlet of channel 16, as illustrated in FIG. 4 by trace 80. The pulses have a frequency and period which coincides with the switching frequency and period and an amplitude that is determined by the pressure of the fluid supplied to inlet 30.

In the embodiment illustrated in FIG. 1, an optional configurable vent aperture or hole 90 may be connected by way of a fluid flow vent channel 92 to the blind volume's second fluid flow channel 14, slightly downstream from the junction 18. Configurable vent hole 90 may be plugged or opened and is selectively connectable by way of an interconnect channel (illustrated at 94 by dotted lines), to the output end of 54 of the fluid flow channel 16, and thus to the output 54 of the device 10. The optionally configurable vent hole 90 and interconnect channel 94 are principally used in pulsed flow applications where only gas is the pulse fluid. For those applications where the pulsed fluid is to be a liquid, the optional and configurable vent hole 90 is plugged or omitted.

In those applications using gases, when the fluid jet has switched to the left, output leg 16, the gas accumulated in the blind volume reverses flow direction and starts bleeding out with part of the flow passing through the vent hole 90 through the interconnect channel or passage 94 that connects the output vent hole to the output leg, as illustrated in FIG. 1, so that no gas (e.g., air) is vented to the atmosphere. As the air in the blind volume bleeds away, the pressure in the blind volume (and hence the right leg 14) drops below the second critical pressure and the fluid jet switches back to the right (or biased) leg, and the cycle of switching between biased flow into the right leg and the critical pressure directed flow to the left (or outlet) leg repeats with a pulse period controlled by inlet flow rate and the selected volume for the blind volume container 46, as discussed above.

When air is the fluid, the result is a pulsating air stream at a frequency determined by the size of the blind volume. Larger volumes result in lower pulse frequency and vice versa. Therefore, the optional variable or adjustable volume container may be incorporated to permit user adjustable control of the frequency. For liquids, the switching can occur without a vent hole. For devices including the optional vent hole, the fluid flow does not shut off completely between pulses, meaning there is a base (or DC-like) flow through the outlet 54. Without the vent hole, for liquids, there is full shutoff between pulses.

The fluidic pulser of the present invention operates to produce a continuous and periodic train of fluid pulses with no moving parts, and achieves a pulsating pressure effect due to its fluidic geometry. The device is readily configured for reliable use with both water and air, or in general liquids and gases, requires no external power supply, and is powered, in the illustrative embodiment, solely from energy in the supplied fluid stream, where the fluid to be delivered to an outlet in pulses comes from a pressurized fluid source and is modulated, or switched, to pulse-modulate the outlet fluid stream.

In fluidic circuits constructed in accordance with the present invention, delivered, or output flow rates at the outlet 54 can range from 0.25 to 100 liters per minute (lpm), input fluid pressures can vary from 1 to 60 pounds per square inch (psi), and output pulsation frequency can be varied from 1 to 100 pulses per second (Hz).

The amplitude of the pressure pulses, such as those illustrated at 80, can be controlled by the angles 70 and 72 between the two legs 14 and 16 of the Y (which may be referred to as the "inter-leg" angle between the outlet leg and the blind volume's leg, as viewed from the Y junction). The lumen area of the output hole 54 and the lumen area of the power nozzle 34 at the downstream terminus of the inlet leg 12 are selected together to enhance the stability of the oscillations. It has been found that the fluidic circuit pulser/oscillator 10 of the invention works best for air when the first, second and third channels have aspect ratios (AR) (depth/width) of 0.3-0.9, the vent hole area is 1.5 times larger than the power nozzle area, and the output hole 54 is considerably larger (about 12 times) than the power nozzle area.

Experimental development work, using air as the fluid, has shown that in one working example of the invention an inter-leg or included angle of the Y junction of 41 degrees provided an optimal high pulse amplitude. In this example, the lengths of the Y channels were preferably about 24 times the power nozzle width (Pw). As an example, for a flow rate of 2 lpm (air) at about 1.5 psi, a Pw=0.3", an AR of 0.6 and a blind volume of approximately 2 oz (3.6 cu. in.) can be used to produce a pulse frequency of about 10 Hz at an output hole lumen 54 having an area approximately 12 times the power nozzle lumen area. The resulting output pressure is that shown at 80 in FIG. 4, which shows a plotted trace of sensed pressure as a function of time ("output pressure" as measured from a pressure tap, best seen in FIG. 5) for an exemplary embodiment of the pulser fluidic circuit of the present invention, using air as a fluid. For the output shown in FIG. 4, the parameters of interest were: Air Flow=4 lpm, input pressure=1.25 psi, frequency=12 Hz, amplitude=0.3-0.35 psi.

The size of the vent hole 90, for gases, is also important for ensuring the steady operation of the fluidic device. Experimental development work (with air as the fluid) indicates that a preferred vent hole lumen area should be approximately 1.5 times the power nozzle lumen area.

Figure 5:
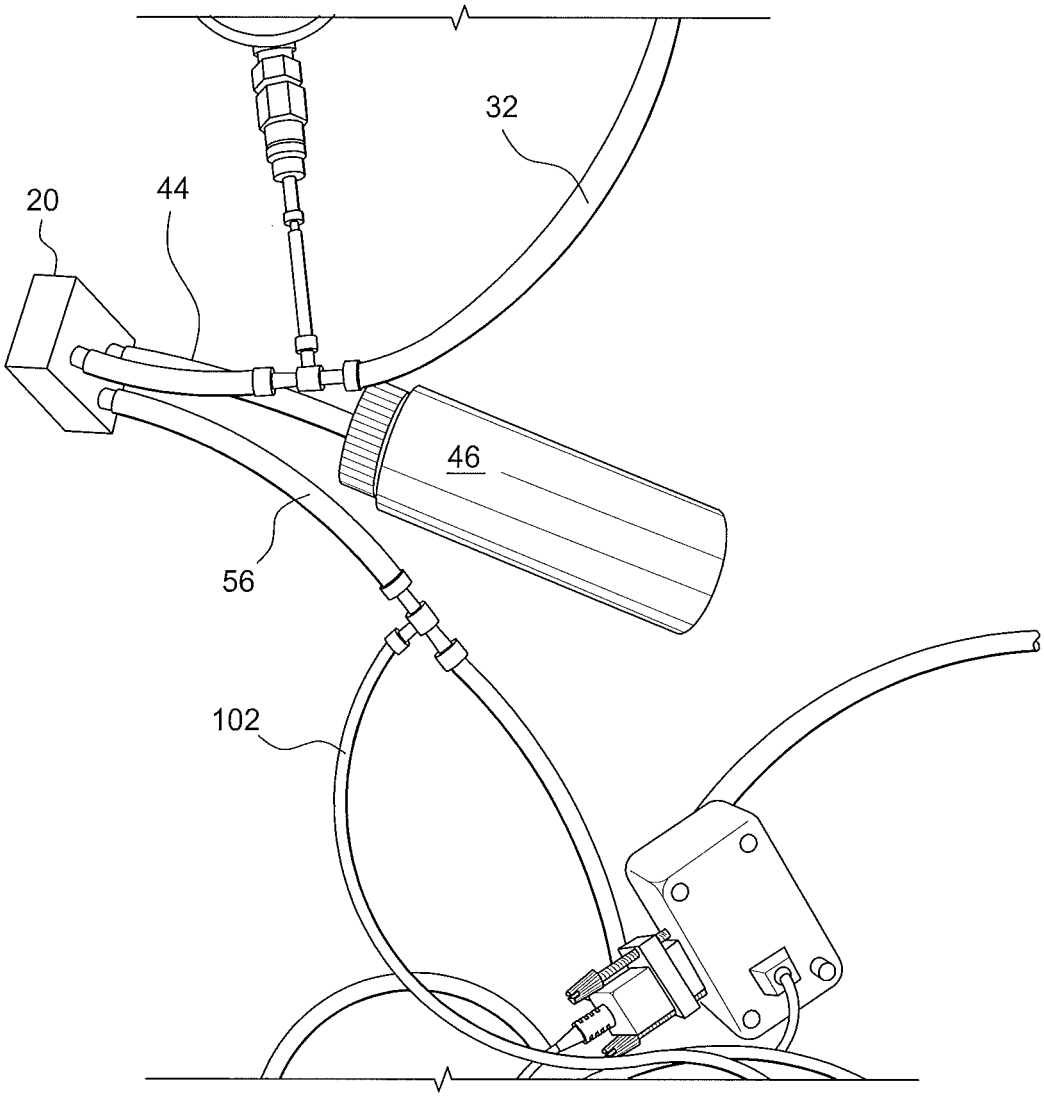
FIG. 5 illustrates a working model of a fluid oscillator system utilizing the device of FIG. 1.

FIG. 5 illustrates a developmental set up, in accordance with an exemplary embodiment of the apparatus and method of the present invention. The fluidic oscillating pulser 10 of FIG. 1 is illustrated as being connected via tube or conduit 32 to a source of pressurized air, as well as to a blind volume container 46 defining the blind volume and to an output conduit 56 at the output 54.

Figure 6:
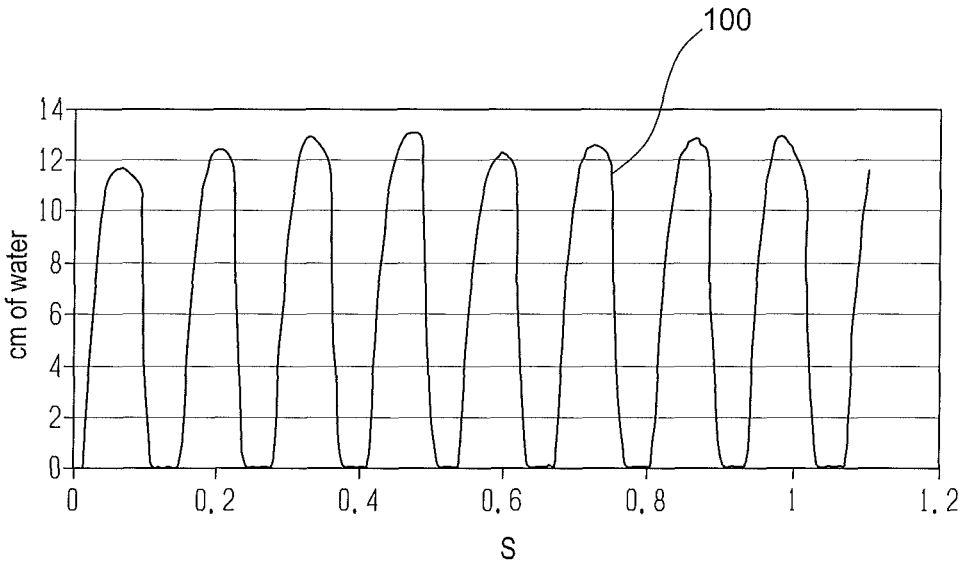
FIG. 6 illustrates a plotted trace of the output pressure from a scaled-down version of the device of FIG. 1.

FIG. 6 illustrates another plotted trace 100 of sensed pressure at the outlet 54 as a function of time ("output pressure" as measured from the pressure tap) with a scaled down version of the device that is illustrated in FIG. 1. In this version, the parameters of interest were: Air Flow=2 lpm, input pressure=1.5 psi, frequency=8 Hz, peak amplitude~14 cm of water, where 1 psi=70 cm of water.

The fluidic device of the present invention can operate over a wide range of fluid outlet back pressure conditions, which means it can be connected to a nozzle or to other devices. FIG. 5 shows an output device 102 connected downstream of the pulser. The amplitude may be dampened as a result of such a connection and, for excessively high back pressures, the pulsations will cease.

The apparatus and method of the present invention can be used in micro-irrigation for low flow and ultra low flow applications. By introducing a selected duty cycle, the total flow rate can be reduced without introducing many pressure drops or compromising filter dimensions, and this embodiment can be adapted for use in agricultural applications. The apparatus and method of the present invention can also be used in therapeutic or medical applications with air, water or mixed fluids.

Persons of skill in the art will appreciate that the present invention, as illustrated in exemplary embodiments of FIGS.

1-6 provide a configurable fluidic oscillator 10 capable of generating pulsed gas or liquid jets having controllable periodic pulsed flow, where the oscillator includes a switching junction region 18 supplied via an inlet 30 that allows a pressurized fluid (i.e., gas or liquid) to enter and flow through the oscillator, an exhaust channel or passage 16 having an inlet sidewall that forms a first boundary wall of the switching junction region 18 and terminates distally in an exhaust passage outlet 54. The blind volume container passage 14 has a sidewall that forms a second boundary wall of the switching junction region 18, and blind volume container 46 is connected to the distal end of container passage 14, where the blind volume passage 14 is in fluid communication with a selectively configurable vent and gas passage 94 which terminates the exhaust passage outlet 54. The adjustable blind volume container 46 and its contents work together to provide said container passage distal end with selected "air spring" like compliance, and the exhaust passage outlet is configured to allow pulsed fluid to flow from the oscillator's outlet 56. Fluidic oscillator 10 is operable to yield a fluid jet that issues from the inlet port into the switching junction region and alternately switches its flow direction between the blind volume container and the exhaust passage 16, where the switching action generates controllable pressure waves in the exhaust passage 16 control the continuous pulsed flow of gas or liquid from the outlet or orifice 56.

Having described preferred embodiments of a new and improved fluidic apparatus 10 and method, it is believed that other modifications, variations and changes will be suggested to those skilled in the art in view of the teachings set forth herein. It is therefore to be understood that all such variations, modifications and changes are believed to fall within the scope of the present invention, as set forth in the following claims.

What is claimed is:

1. A fluidic circuit configured to produce a continuous sequence of periodic pulses of gas or liquid flow having a selected pulse repetition frequency, pulse duration, pulse peak pressure and pulse peak flow rate, comprising:

first, second and third fluid flow controlling channels which intersect at a junction which defines a fluid interaction region to define a "Y" configuration having a base leg and right and left diverging arms, respectively, said fluid flow channels having corresponding base leg, right leg and left leg flow axes;

said first, base leg fluid controlling channel having a fluid inlet at a first end, a second, downstream end terminating at said Y junction, and having gradually converging walls which are configured to reduce the cross sectional area of fluid flow in the first channel from the first end to the second end to thereby increase fluid velocity to produce a fluid jet along said base leg axis at said junction;

said second, right leg fluid controlling channel having an inlet at said Y junction and having a distal end terminating in an enclosed, fluid-tight container having a selected blind volume, wherein the flow axis of said right leg diverges from the axis of said base leg by a first angle;

said third, left leg fluid controlling channel having an inlet end at said Y junction and having a distal end terminating in a fluid outlet passage having a selected cross-sectional area, wherein the flow axis of said left leg diverges from the axis of said base leg by a second angle;

wherein said second leg channel is in fluid communication with a vent connecting said second leg channel through a selectively configurable interconnect channel to said distal end of said third leg channel; and said first and second angles being on opposite sides of said base leg axis and wherein said second angle is greater than said first angle.

2. The fluidic circuit of claim 1, wherein said second leg channel is selectively configurable with the vent connected through said interconnect channel to said distal end of said third leg channel.

3. The fluidic circuit of claim 2, wherein said fluid is a gas.

4. The fluidic circuit of claim 3, wherein said gas is air.

5. The fluidic circuit of claim 1, wherein said first angle is selected to bias fluid flow from said first fluid flow channel into said second fluid flow channel, and wherein said container blind volume diverts fluid flow from said second leg channel to said first leg channel when a predetermined fluid pressure is reached in said container.

6. The fluidic circuit of claim 5, wherein fluid flow returns to said second leg channel periodically to produce a pulsating outlet air stream at a frequency determined by the size of said blind volume.

7. The fluidic circuit of claim 5, further including an adjustable volume container to permit adjustable control of the outlet air stream pulse frequency.

8. A method of producing fluidic pulses, comprising;

supplying a selected fluid under pressure to a fluid inlet channel in a first leg of a fluidic circuit;

producing a fluid jet at a downstream end of said first leg channel at a junction with fluid channels in second and third legs, respectively, of said fluidic circuit, wherein said fluid channels in said first, second and third legs form a Y shaped junction and said second and third leg channels diverge at first and second angles, respectively, from the direction of said first leg channel on opposite sides of the direction of said fluid jet, and wherein said second leg channel is in fluid communication with a vent connecting said second leg channel through a selectively configurable interconnect channel to said distal end of said third leg channel ;

aligning said third leg channel at a slightly greater angle than the angle of said second leg channel with respect to the direction of said fluid jet from said first leg channel, causing the inlet fluid jet flow from said first channel to be attached to a channel wall leading into said second leg channel to thereby bias inlet fluid flow of said fluid jet towards said second leg channel at the Y junction;

terminating a distal end of said second leg channel in fluid communication with a fluid-tight container defining a blind volume;

causing inlet fluid flow to fill said blind volume and to thereby increase the pressure within it until a critical pressure is reached;

causing, once the critical pressure in the blind volume has been achieved, the fluid flow at the Y junction to switch into said third leg channel and to flow through said third leg channel to an outlet to produce an outlet fluid flow until the pressure in said blind volume has been reduced; and thereafter causing said inlet fluid flow to switch back to said second fluid channel until said critical pressure in said blind volume has been reached, whereby continued switching of said fluid flow between biased flow into second leg and critical pressure-directed flow to third leg repeats produces a pulsed outlet flow at the outlet of said third leg channel.

9. The method of claim 8, further including reducing the pressure in said blind volume by bleeding fluid from said container through said optionally connected selectively configurable interconnect channel to said distal end of said third leg channel to provide a vent while the inlet fluid jet is flowing into said third leg channel to said outlet.

10. The method of claim 9, wherein said bleeding fluid from said container includes directing fluid from said container through said selectively configurable vent to said outlet.

11. A fluidic oscillator configured to generate pulsed gas jets having controllable periodic pulsed flow, said oscillator comprising:

a switching junction region having an inlet port that allows a pressurized fluid to enter and flow through said oscillator, an exhaust passage having an inlet sidewall that forms a first boundary wall of said switching junction region and terminates distally in an exhaust passage outlet;

a container passage having a sidewall that forms a second boundary wall of said switching junction region, a blind volume container connected to the distal end of said container passage, wherein said container passage is in fluid communication with a selectively configurable vent and gas passage which terminates at said exhaust passage outlet;

wherein said blind volume container and its contents are configured to provide pulsed gas jets having a selected pulse frequency controlled by said container's blind volume which provides a selected compliance, and said exhaust passage outlet is configured to allow pulsed fluid flow with said selected pulse frequency from said oscillator.

12. A fluidic oscillator as recited in claim 11, wherein said oscillator being operable so as to yield a fluid jet that issues from said inlet port into said switching junction region and alternately switches its flow direction between said container and exhaust passages, said switching action serving to generate controllable pressure waves in said exhaust passage and expansion chamber, with said pressure waves acting to control the continuous pulsed flow of said fluid from said orifice.

13. A fluidic oscillator as recited in claim 11, wherein said exhaust and container passages having tapered sidewalls which converge toward said switching junction region.

14. A fluidic oscillator as recited in claim 11, wherein said blind volume container has an adjustable volume configured for adjusting said fluid pulse frequency.

* * * * *